US006394752B1

(12) United States Patent
Lai

(10) Patent No.: US 6,394,752 B1
(45) Date of Patent: May 28, 2002

(54) LINK STRUCTURE FOR RODS

(76) Inventor: Wei-Cheng Lai, No. 100-36, Der Sheng Village, Hukou Hsiang, Hsinchu Hsien (TW)

( * ) Notice: Subject to any disclaimer, the term of this patent is extended or adjusted under 35 U.S.C. 154(b) by 0 days.

(21) Appl. No.: 09/580,308

(22) Filed: May 26, 2000

(51) Int. Cl.[7] ..... A63H 33/40; F21V 33/00

(52) U.S. Cl. ..... 416/5; 403/349; 362/96; 446/217

(58) Field of Search ..... 416/5, 244 R, 416/245 R; 362/96; 446/217, 218; 403/349

(56) References Cited

U.S. PATENT DOCUMENTS 1,711,932 A * 5/1929 Ferreby ..... 362/35
2,857,507 A * 10/1958 Stec ..... 362/232 X
3,974,369 A * 8/1976 Chmela et al. ..... 362/190
5,092,809 A * 3/1992 Kessler ..... 446/217
6,082,868 A * 7/2000 Carpenter ..... 416/5 X

* cited by examiner

*Primary Examiner*—John E. Ryznic

(57) ABSTRACT

A link structure for rods is disclosed, the structure includes a link member and two rods. The link member is in the form of a cylinder, and is provided at the middle thereof with a raised annular portion with a larger diameter, two protrusions are provided respectively on the upper and lower portions of the link member. The two rods are connected respectively with the two ends of the link member. The rods are hollow on the connecting ends thereof; the inner diameter of each rod is coincident with the external diameter of the link member. The rods are provided on the peripheries of the connecting ends thereof each with an "L" shaped notch, the protrusions of the link member can be engaged in the "L" shaped notches to connect the two rods to form a longer rod.

7 Claims, 7 Drawing Sheets

LINK STRUCTURE FOR RODS

BACKGROUND OF THE INVENTION

1. Field of the Invention

The present invention is related to a link structure for rods, and especially to a link structure which can connect two rods to form a longer rod in a convenient way.

2. Description of the Prior Art

In various festivals, various brilliant lamp strings and decorations are used, thereby, dull buildings or plain meadows are given with splendor. A decorative lamp tree is one of such kinds; it is an artificial lamp tree in simulating the contour of a tree and has a variety of modeling. It can be as real as a X'mas tree, or can be a stereoscopic helical article, giving a sense of wonder. However, a decorative lamp tree with the height of 2–4 m can have quite a problem in storing; therefore generally, the supporting main body such as the shank of a tree can be disconnected. That is, the shank of a tree is separated into several sections when not in use, and the sections are connected to form the whole shank of 2–4 m in height when in use. The link structure for rods of the present invention is exactly of this kind.

SUMMARY OF THE INVENTION

Therefore, the primary object of the present invention is to provide a link structure for rods which is easy for use, assembling and fixing, and is comprised mainly of a link member and two rods capable of fitting over the opposite ends of the link member. When in fitting over, the rods are simultaneously rotated to secure their relative positions; then they are not subjected to separation. The present invention thus is a practicable design.

The secondary object of the present invention is to provide a decorative lamp tree which uses a link structure of the present invention assemblable with other members such as a lamp string set, a round-disk seat, a foot and a plurality of fixing nails etc. to make the whole modeling as an elevated tree, the lamp string set can be radiatively hung down all around from the top to form a beautiful modeling of the decoration lamps.

Another object of the present invention is to provide a decoration structure of a windmill which uses a link structure of the present invention assemblable with other members such as a main shank, a rotary wheel, a plurality of fixing pieces etc. The lamp bulbs of a plurality of lamp strings can be mounted in the main shank, when they are lightened, light beams can be irradiated from inside outwardly, plus rotation of the blades of the rotary wheel, a colorful and brilliant modeling can be obtained.

The present invention will be apparent in its details and technical contents after reading the detailed description of the preferred embodiments thereof in reference to the accompanying drawings.

DETAILED DESCRIPTION OF THE PREFERRED EMBODIMENT

Figure 1:
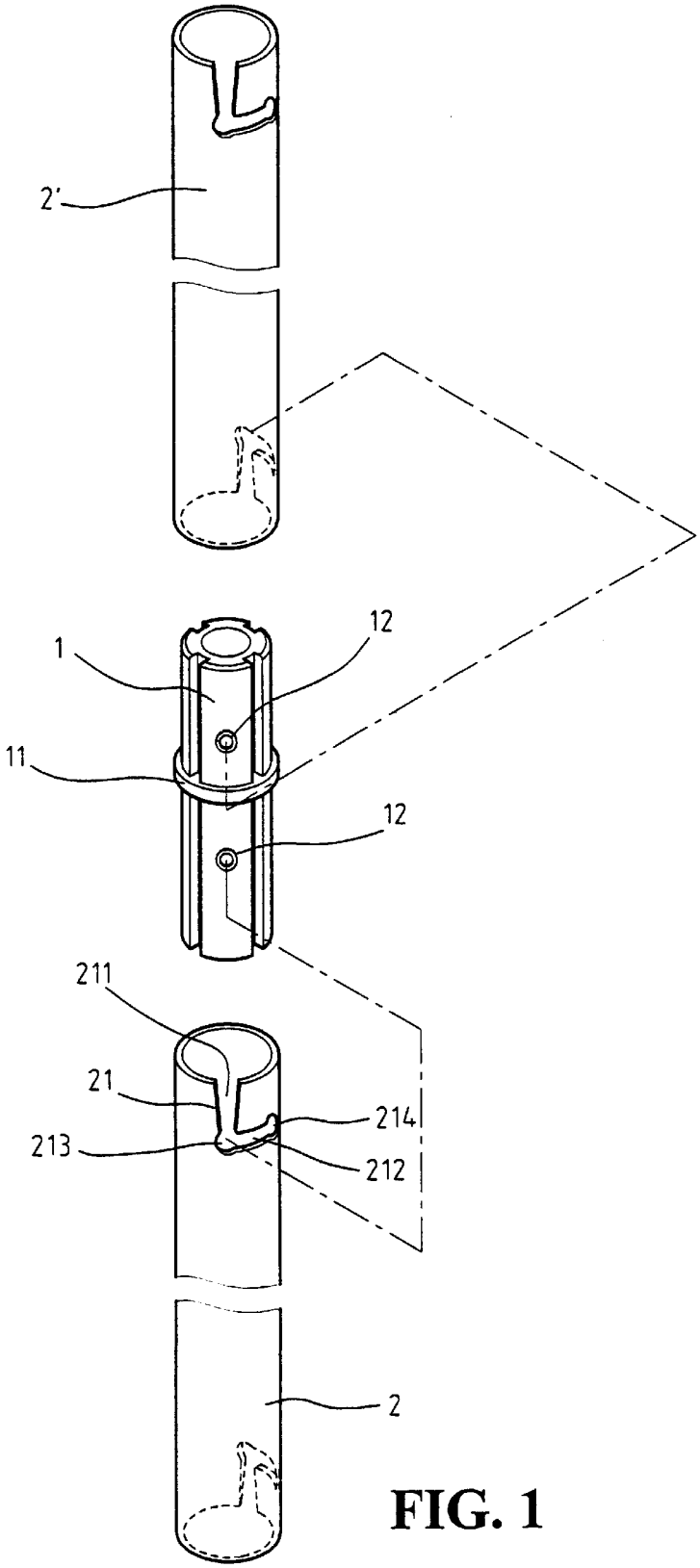
FIG. 1 is an analytic perspective view showing the first preferred embodiment of the present invention.

Referring to FIG. 1 which is an analytic perspective view of the first preferred embodiment of the present invention, this embodiment is comprised of a link member 1 and two rods 2, 2', the link member 1 is in the form of a cylinder, and is provided at the middle thereof with a raised annular portion 11 with a larger diameter, two protrusions 12 are provided respectively on the upper and lower portions of the link member 1 to engage with the rods 2, 2' when in assembling. The two rods 2, 2' are respectively connected with the two ends of the link member 1. Taking the rod 2 as an example, the rod is hollow on the connecting end thereof—in this embodiment, the rod 2 is a hollow pipe—actually, it only needs that the connecting end thereof is hollow. The inner diameter of the hollow end of the rod 2 is coincident with the external diameter of the link member 1. The rod 2 is provided on the periphery of the connecting end thereof with an "L" shaped notch 21, a longitudinal slit 211 of the notch 21 tapers down from the top of the rod inwardly as shown in the drawing of FIG. 1, and a transverse slit 212 of the notch 21 has both ends thereof enlarged to form larger round holes 213 and 214 respectively. The diameter of the round holes 213 is coincident with the external diameter of one of the protrusions 12, for the purpose that the protrusion 12 of the link member 1 can be easily inserted into the "L" shaped notch 21 but can not easily drop from the latter.

When in assembling, just align the "L" shaped notch 21 of the rod 2 with one of the protrusions 12 of the link member 1, and rotate the rod 2 an angular distance when it is inserted to the end of the longitudinal slit 211 of the notch 21, the protrusion 12 can be engaged in the round hole 214 of the notch 21 of the rod 2; the rod 2 cannot easily drop from the link member 1. In the same way, the rod 2' can be engaged with the other end of the link member 1. In this mode, the two rods 2, 2' can be connected to form a longer rod by engaging with the link member 1; when a plurality of rods are connected with a plurality of link members, an even much longer rod can be obtained by such easy assembling work, the long rod is not subjected to tearing apart. Thereby, the present invention is a novel and practicable invention.

Figure 2:
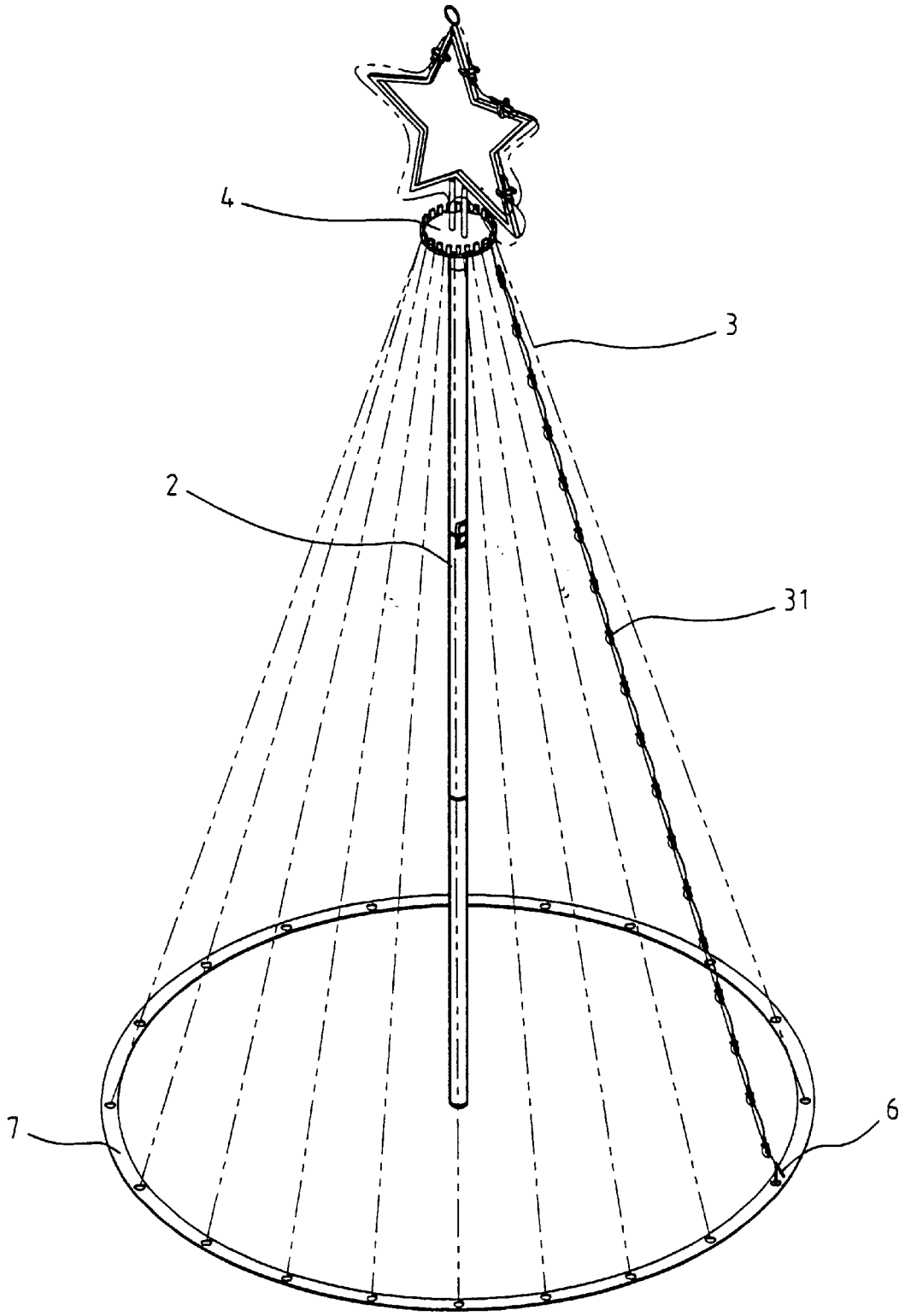
FIG. 2 is a perspective view of the second preferred embodiment of the present invention.
Figure 3:
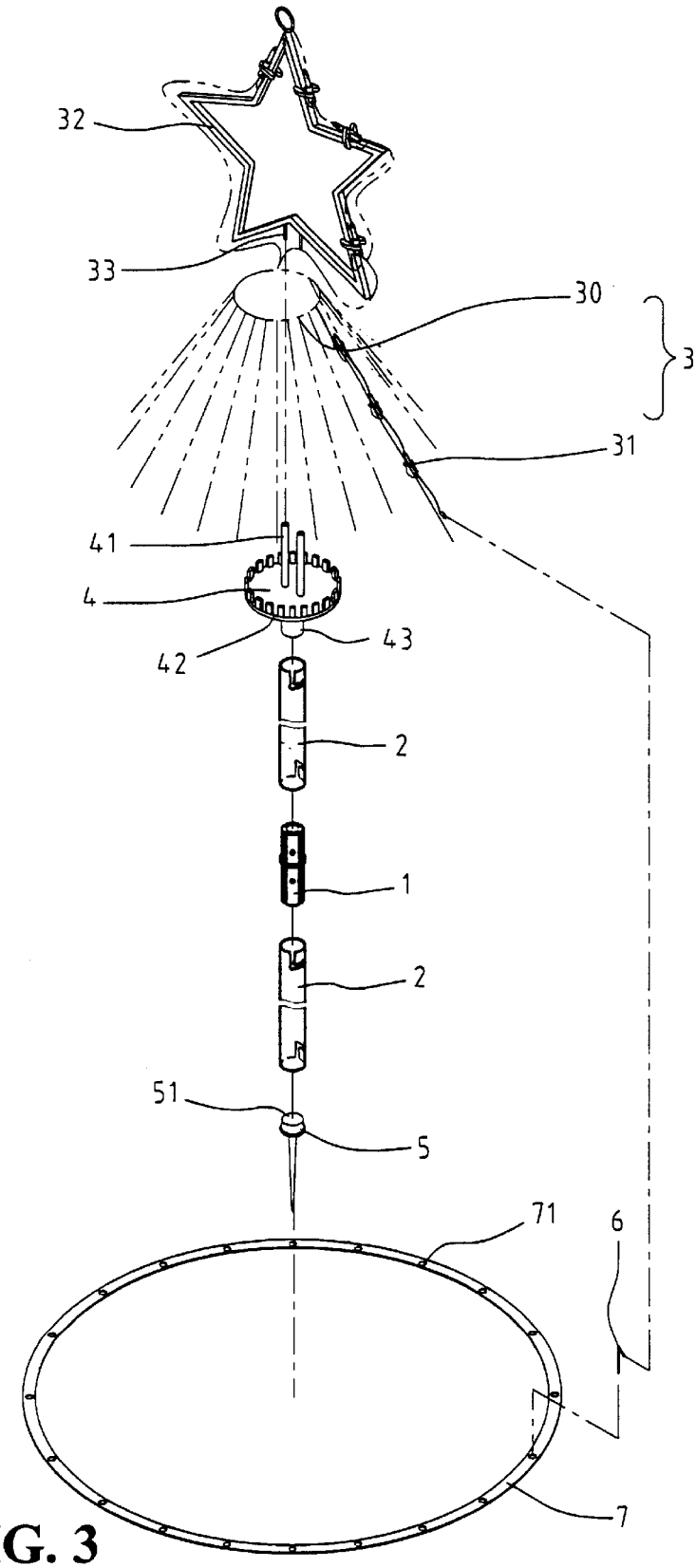
FIG. 3 is an analytic perspective view of the second preferred embodiment of the present invention.

Referring now to FIGS. 2 and 3 which are respectively a perspective view and an analytic perspective view of the second preferred embodiment of the present invention, wherein, the link structure for rods of the present invention is combined with other members to form a decorative lamp tree. The decorative lamp tree is comprised of a lamp string set 3, a round-disk seat 4, a plurality of rods 2, a plurality of link members 1, a foot 5 and a plurality of fixing nails 6 etc. The lamp string set 3 includes a plurality of lamp strings 31 connecting one by one, a circle 30 is provided on the top of the lamp string set 3, and the lamp string set 3 is radiatively hung down all around from the top. An ornament 32 can be connected with the lamp string set 3 to be mounted on the round-disk seat 4, in order to give an aesthetic appearance. In the present embodiment, the ornament 32 is a pentagram having two insertion stems 33 for inserting into two insertion pipes 41 centrally provided on the round-disk seat 4 to have it secured.

The round-disk seat 4 is used mainly to make pending of the lamp strings 31 of the lamp string set 3 all around from the top without tangling. For this, a plurality of notches 42 are provided on the periphery of the round-disk seat 4 each for pulling out of a lamp string 31; the bottom of the round-disk seat 4 is provided with a cylindrical connecting stub 43 to be inserted into a hollow pipe on the top of a rod 2 to secure its position. The structure of the rods 2 and the link member 1 are shown as in FIG. 1. The foot 5 is used primarily for fixing a rod 2 on the ground, and a cylindrical head 51 on the top of the foot 5 is used to connected with the rod 2 with an inner diameter coincident with the external diameter of the cylindrical head 51, the bottom of the foot 5 is a pointed tip for inserting in the ground of earth or grass.

The fixing nails 6 each has a hook on the top end thereof to hook the tailing end of a lamp string 31 and to be inserted in the ground, the whole decorative lamp tree can thus be uniformly spread in a radiation state which expresses an excellent aesthetic appearance. The present invention includes further a model circle 7 provided equidistantly and equiangularly thereon with a lot of pierced holes 71. The amount of the holes 71 is coincident with that of the lamp strings 31 of the lamp string set 3. The fixing nails 6 are arranged in this embodiment to make the lamp strings 31 distribute to form a conical shape according to the circular shape arrayed by the holes 71 of the model circle 7, this gives better reference positions for the fixing nails 6 in securing the lamp strings 31. Therefore, an even more beautiful modeling is obtained.

As shown in FIG. 2, when it is to assembly, the rods 2 and the link members 1 will be mutually connected to form an elongated supporting post to support the central body of the whole assembly; the round-disk seat 4 is connected with the topmost ends of the rods 2 and allows the lamp strings 31 of the lamp string set 3 to be radiatively hung down all around from the top through every notches 42 provided on the periphery of the round-disk seat 4. While the fixing nails 6 fix one end of each lamp string 31 to the ground. By using the model circle 7, a beautiful modeling of the whole assembly can be obtained. The foot 5 is connected with the bottom end of a rod 2, thereby, the whole assembly can be used on an outdoor meadow to form a brand-new and beautiful decorative lamp tree.

Figure 4:
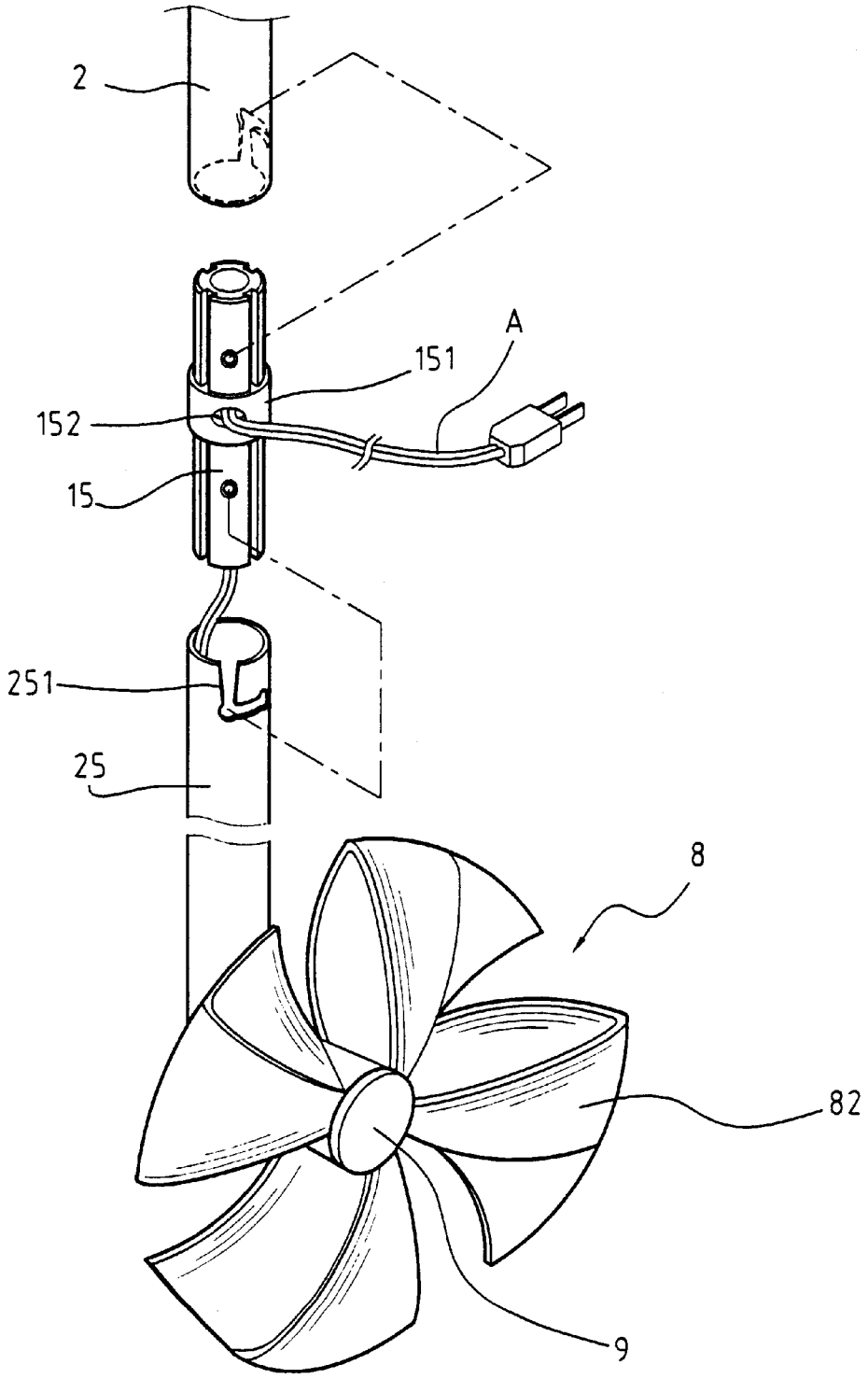
FIG. 4 is a perspective view of the third preferred embodiment of the present invention.
Figure 5:
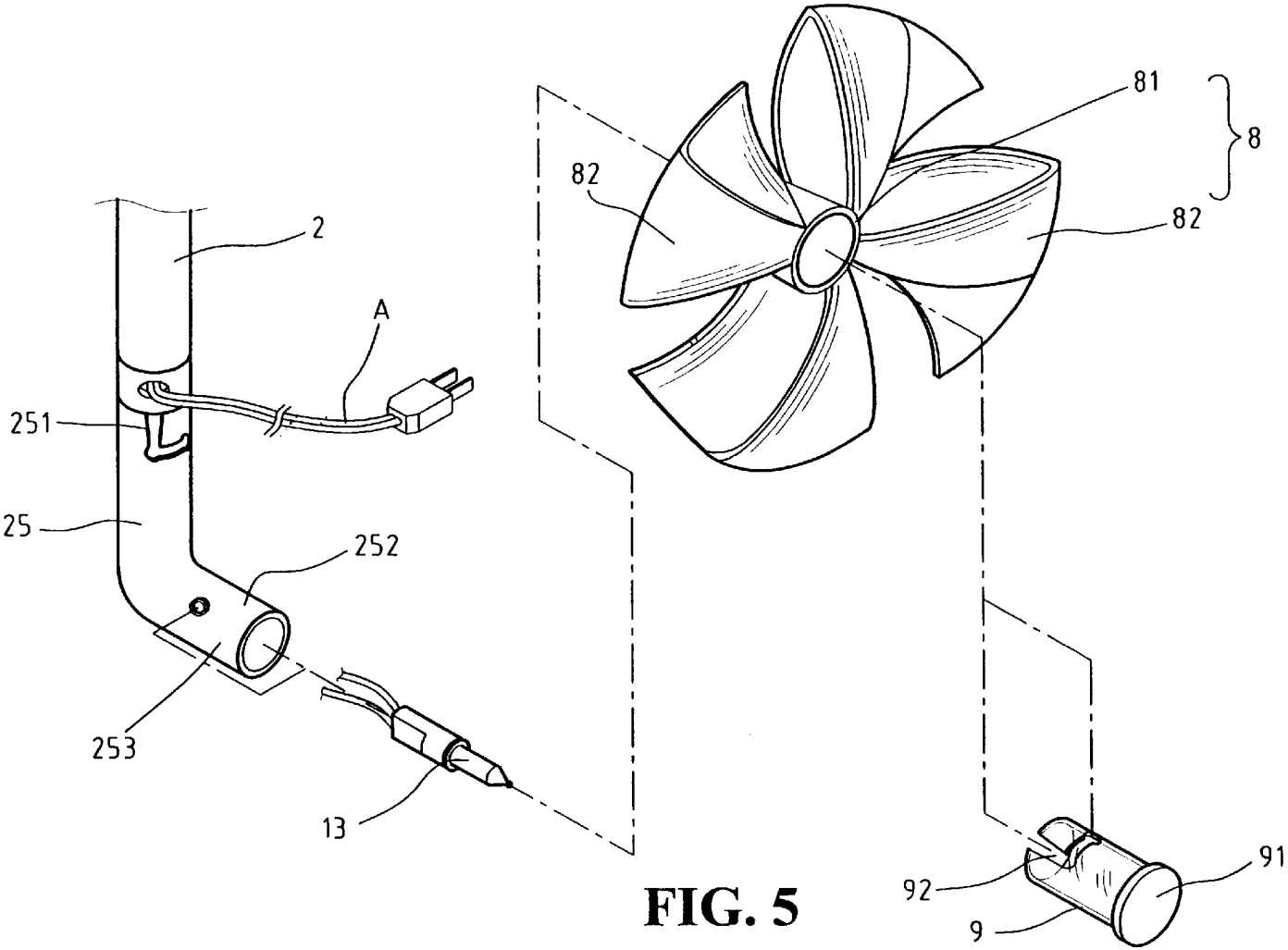
FIG. 5 is an analytic perspective of the third preferred embodiment of the present invention.

Referring now to FIGS. 4 and 5 which are respectively a perspective and an analytic perspective of the third preferred embodiment of the present invention, wherein, the link structure for rods of the present invention is combined with other members to form a decorative windmill. The decorative windmill is structurally comprised of a plurality of rods 2, a link member 15, a main shank 25, a rotary wheel 8 and a fixing piece 9 etc. The link member 15 is structurally identical to the link member 1 in FIG. 1 except that the link member 15 is a hollow pipe, the annular portion 151 thereon is wider and is provided with a through hole 152 for extending of a conductor therethrough to the exterior to connect with an electric power source. The main shank 25 is a hollow pipe and is provided with a top "L" shaped notch 251 for connecting with the link member 15. And the main shank 25 is bent on the bottom end thereof to form an "L" shaped pipe, the transverse rod portion 252 of the main shank 25 is provided peripherally with a protrusion 253 for connecting with the fixing piece 9 to prevent the rotary wheel 8 from dropping in use.

A hollow axle 81 is provided centrally of the rotary wheel 8 and is made of material with good transparency. The rotary wheel 8 is provided peripherally with a plurality of arciform blades 82, so that when wind blows the blades 82, the rotary wheel 8 will rotate. And the fixing piece 9 is used mainly for prevent the rotary wheel 8 from dropping off the transverse rod portion 252. The fixing piece 9 is provided on one end thereof with a round member 91 of which the diameter is larger than the inner diameter of the axle 81 of the rotary wheel 8; the main body of the fixing piece 9 is hollow to slip over the end of the transverse rod portion 252. The fixing piece 9 is provided on the other end thereof with an "L" shaped notch 92, when in assembling, the protrusion 253 of the transverse rod portion 252 can be engaged therein to further prevent the fixing piece 9 from dropping.

Figure 6:
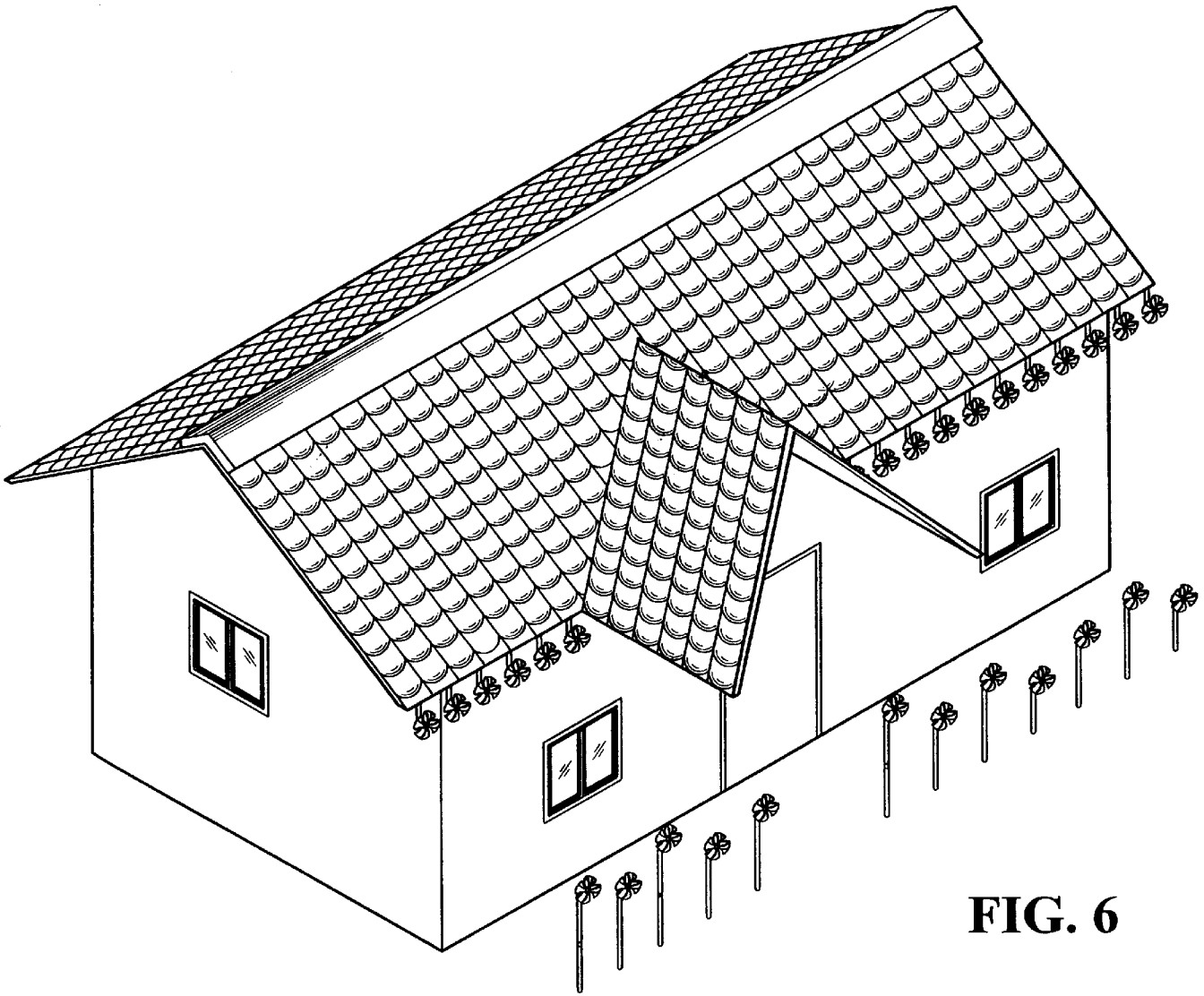
FIG. 6 is a schematic view showing a plurality of products of the third preferred embodiment of the present invention are disposed externally around a house.

When in assembling, a lamp bulb 13 is placed in the transverse rod portion 252 on the bottom of the main shank 25: in the first place, then the axle 81 of the rotary wheel 8 is slipped over the fixing piece 9 to make engagement of the protrusion 253 with the notch 92, and relative positions of the members can be secured. In this embodiment, the transverse rod portion 252 of the main shank 25, the rotary wheel 8 and the fixing piece 9 are all made of material with good transparency; this is mainly for the purpose for penetrating of light of the lamp strings outwardly to generate specific brilliant visual effect by cooperation with rotation of the blades 82. If the blades 82 have various colors thereon, a more beautiful visual effect can further be provided. As shown in FIG. 6, by arrangement of the rods and link members, each decorative windmill can have variation in height, when they are used outdoors or in the surroundings of a building, a more beautiful scene can be obtained.

Figure 7:
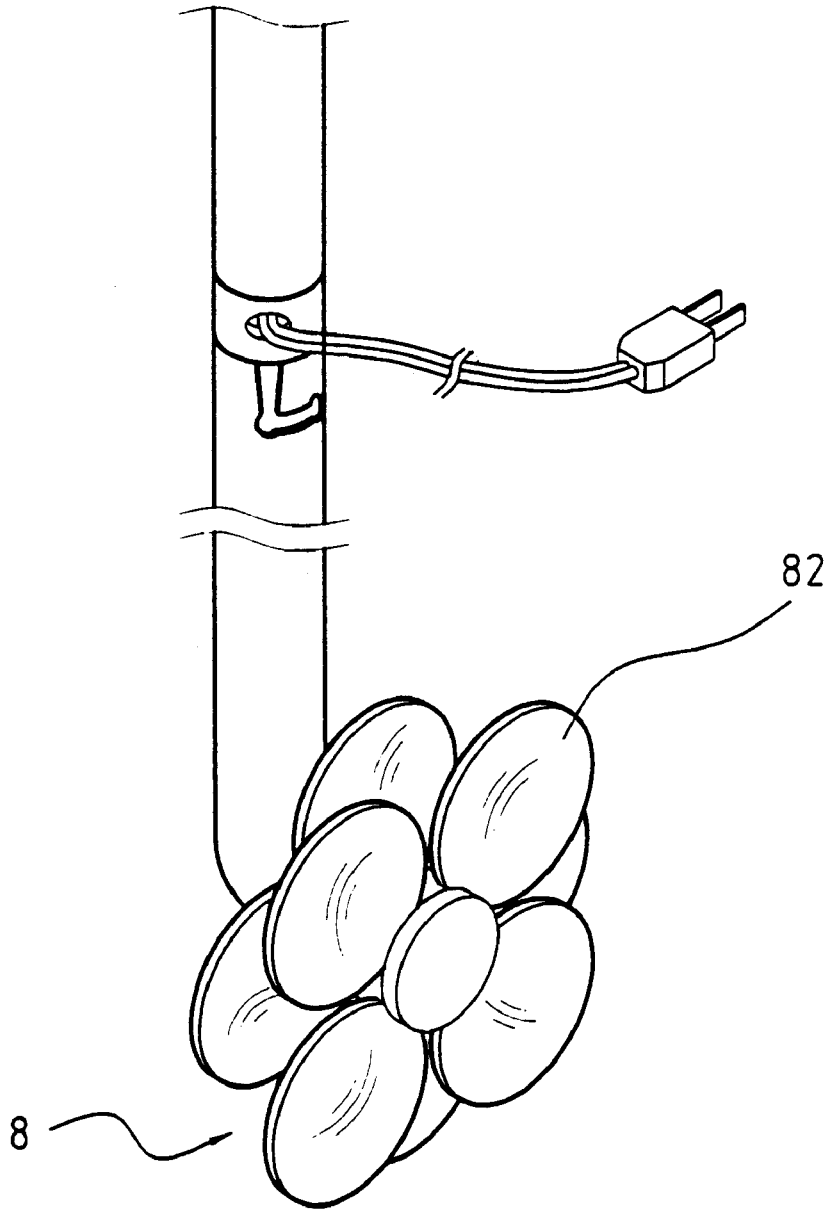
FIG. 7 is a perspective view of the fourth preferred embodiment of the present invention.

Referring now to FIG. 7 which is a perspective view of the fourth preferred embodiment of another kind of decorative windmill of the present invention, The embodiment is structurally identical to that in FIGS. 4 and 5 except that the shape of the blades 82 of the rotary wheel 8 is modeled as a flower, this is more beautiful for visual sense.

The aforesaid is only for illustrating a preferred embodiment of the present invention, and not for giving any limitation to the scope of the present invention. Accordingly, all such modifications and changes also fall within the scope of the appended claims and are intended to form part of this invention.

What is claimed is:

1. A decorative windmill, said decorative windmill is comprised of: a main shank, a rotary wheel, a fixing piece and a lamp string, wherein: said main shank is a hollow pipe and is bent on the bottom end thereof, a transverse rod portion of said main shank is provided peripherally with a protrusion, said transverse rod portion is made of material with good transparency; said rotary wheel is also made of material with good transparency, a hollow axle is provided centrally of said rotary wheel which is provided peripherally with a plurality of blades; said fixing piece is also made of material with good transparency, the main body of said fixing piece is hollow to slip over the end of said transverse rod portion, said hollow axle of said rotary wheel is slipped over said main body of said fixing piece, said fixing piece is provided on one end thereof with a round member of which the diameter is larger than the inner diameter of said axle of said rotary wheel, and provided on the other end thereof with an "L" shaped notch, when in assembling, said protrusion of said transverse rod portion is engaged therein; said lamp string has its lamp bulb placed in said transverse rod portion of said hollow main shank.

2. A decorative windmill as claimed in claim 1, wherein, said main shank is provided thereon with a top "L" shaped notch.

3. A decorative windmill as claimed in claim 2, wherein, said decorative windmill is further provided with a link member and a plurality of rods, the top end of said main shank is adapted to connecting to said link member and one of said rods to increase the longitudinal length of said main shank; and wherein, said link member is in the form of a cylinder which is provided at the middle thereof with a raised annular portion, two protrusions are provided respectively on the upper and lower portions of said link member; two rods which each is hollow on both ends thereof are connected with said link member, the inner diameter of each of said rods is coincident with the external diameter of said link member, said rod is provided on the periphery of both ends thereof with an "L" shaped notch, said rods connect respectively with the two ends of said link member, said notches each is engaged with one of said protrusions of said link member in assembling, the ends of said rods and said link member used for connecting are hollow.

4. A decorative windmill as claimed in claim 3, wherein, said link member is hollow, said raised annular portion has a larger width, and is provided with a through hole for extending of an electric conductor therethrough to the exterior.

5. A decorative windmill as claimed in claim 1, wherein, said blades of said rotary wheel are arciform.

6. A decorative windmill as claimed in claim 1, wherein, said blades of said rotary wheel are arciform and form the shape of a flower.

7. A decorative windmill as claimed in claim 1, wherein, said blades of said rotary wheel are of various colors.

* * * * *